US012234833B2

(12) United States Patent
Botkin et al.

(10) Patent No.: US 12,234,833 B2
(45) Date of Patent: Feb. 25, 2025

(54) CEILING FAN WITH SNAP-FIT CONNECTOR

(71) Applicant: Hunter Fan Company, Memphis, TN (US)

(72) Inventors: Charles William Botkin, Cordova, TN (US); Rickey Thomas Jones, Memphis, TN (US); Douglas Troy Mason, Horn Lake, MS (US)

(73) Assignee: Hunter Fan Company, Memphis, TN (US)

( * ) Notice: Subject to any disclaimer, the term of this patent is extended or adjusted under 35 U.S.C. 154(b) by 197 days.

(21) Appl. No.: 18/167,207

(22) Filed: Feb. 10, 2023

(65) Prior Publication Data

US 2024/0271632 A1 Aug. 15, 2024

(51) Int. Cl.

| | |
|---|---|
| ***F04D 29/34*** | (2006.01) |
| ***F04D 19/00*** | (2006.01) |
| ***F04D 25/06*** | (2006.01) |
| ***F04D 25/08*** | (2006.01) |
| ***F04D 29/26*** | (2006.01) |

(52) U.S. Cl.

CPC ..... *F04D 29/34* (2013.01); *F04D 19/002* (2013.01); *F04D 25/06* (2013.01); *F04D 29/263* (2013.01)

(58) Field of Classification Search

CPC ..... F04D 29/34; F04D 19/002; F04D 25/06; F04D 29/263

See application file for complete search history.

(56) References Cited

U.S. PATENT DOCUMENTS

| | | | | |
|---|---|---|---|---|
| 6,059,531 | A * | 5/2000 | Tai | F04D 29/34 416/207 |
| 6,699,014 | B1 | 3/2004 | Lam et al. | |
| 6,726,453 | B1 * | 4/2004 | Hsieh | F04D 25/088 416/207 |
| 6,916,156 | B2 | 7/2005 | Tseng | |
| 7,134,844 | B2 | 11/2006 | Robin | |
| 8,845,293 | B1 | 9/2014 | Lowe et al. | |
| 10,502,228 | B2 | 12/2019 | Zauhar et al. | |
| 11,761,454 | B2 | 9/2023 | Yao | |
| 2012/0266510 | A1 * | 10/2012 | Kokenes | G09F 15/0056 40/610 |
| 2019/0145424 | A1 * | 5/2019 | Tai | F04D 29/388 416/220 A |
| 2023/0111026 | A1 | 4/2023 | Wang | |

FOREIGN PATENT DOCUMENTS

| | | | |
|---|---|---|---|
| AU | 2018247367 | A1 * | 4/2020 |
| CN | 105782114 | B | 11/2018 |

* cited by examiner

*Primary Examiner* — Connor J Tremarche
(74) *Attorney, Agent, or Firm* — McGarry Bair PC

(57) ABSTRACT

A ceiling fan assembly having a motor housing with at least one blade iron. At least one blade extending from a root to a tip, and having a set of multiple, spaced, through openings at the root. A snap-fit connector securing the at least one blade to the blade iron and comprising a first element and a second element, spaced from the first element to define an insertion path for the root of the blade.

18 Claims, 7 Drawing Sheets

CEILING FAN WITH SNAP-FIT CONNECTOR

BACKGROUND

Ceiling fans are used to generate airflow within a space or area, often used for cooling or temperature regulation. Ceiling fans can be used in industrial, commercial or farming environments to circulate air to maintain proper temperature regulation. This is commonly accomplished with the use of high volume, low speed fans. Ceiling fans primarily have blades that are attached to the motor housing via blade irons to which the blades are attached with multiple screws or similar fasteners.

BRIEF DESCRIPTION

One aspect of the disclosure relates to a ceiling fan comprising: a motor housing having at least one blade iron; at least one blade extending from a root to a tip, and having a set of multiple, spaced, through openings at the root; and a snap-fit connector securing the at least one blade to the blade iron. The snap-fit connector comprising: a first element and a second element, which is spaced from the first element to define a root gap defining an insertion path for the root of the blade, a set of biased snap pins corresponding to the set of through openings to define complementary pairs of snap pins and through openings. Wherein at least one of the first and second elements is integrally formed as part of the blade iron, and when the blade root is moved along the insertion path, the set of biased snap pins moves out of the insertion path until the through openings align with the set of biased snap pins, which are then biased into the through openings.

DETAILED DESCRIPTION

The disclosure herein is directed to systems, methods, and other devices related to an apparatus and methods for attaching and detaching blades to a motor housing of a ceiling fan. In particular by inserting an end of a blade into a blade snap-fit holding attachment. The blade snap-fit holding attachment can be mounted directly or indirectly to a rotor of the motor for the ceiling fan. The indirect mounting can include an intervening blade iron coupling the snap-fit holding attachment to the rotor. In one aspect the blade holding attachment includes catch plate defining a root gap with ramped surfaces, causing a spring plate to lift and springs of the spring plate to compress. Upon compression, locking posts align with mounting holes in the blades, and the springs bias the catch plate down to lock the blade in place.

In another aspect, the blade snap-fit holding attachment includes a living hinge and a snap fit connector with ramped pins. When the blade is inserted, the snap fit connector pivots along the living hinge, and when the ramped pins align with the mounting holes, the pins snap into the holes, locking the blade in place. In this case, the material memory in the living hinge causes the plate to snap down and lock the blade in place.

Screwing blades onto a ceiling mounted motor results in visible screws. Ceiling fans run under continuous vibration conditions where the screws can loosen causing the blades to become loose or sag. Furthermore, cleaning ceiling fan blades can be messy where dirt and dust fall on furniture and the flooring beneath the ceiling fan. Current techniques have relied on manually holding brushes to the blades themselves which inherently tires the muscles in the cleaner's neck, shoulders, arms and hands. The blade holding attachment described herein allows for easy detachment and reattachment for cleaning blades. Furthermore, the blades described herein can be reversible and/or replaceable, allowing for a décor change without replacing an entire ceiling fan.

Figure 1:
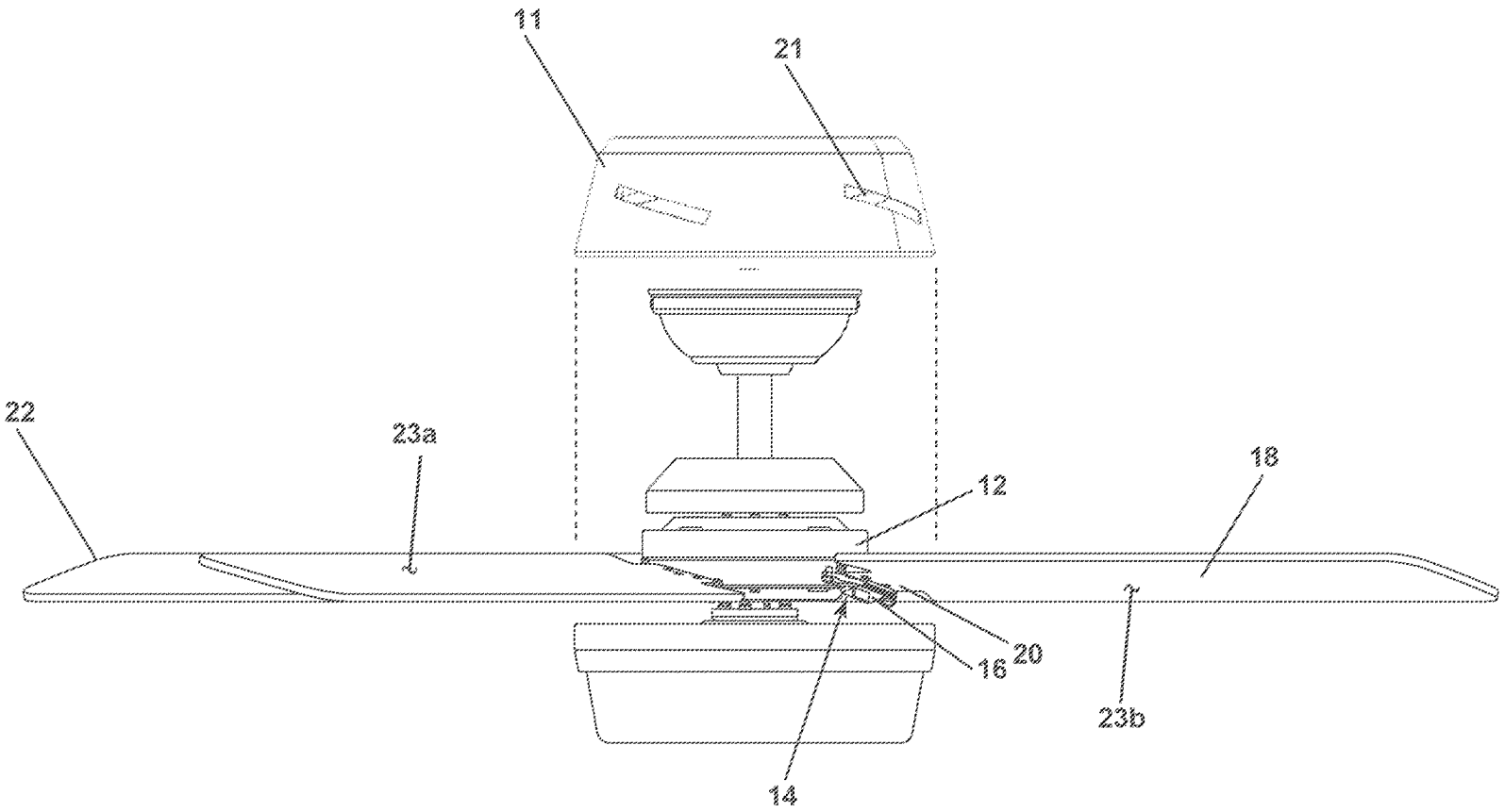
FIG. 1 is a bottom perspective view of a ceiling fan with a snap-fit blade holding attachment.

FIG. 1 is a bottom view perspective drawing of a ceiling fan 10. The ceiling fan 10 includes a motor housing 11 removed from the ceiling fan to illustrate a motor 12, with an inner stator and an outer rotor. The housing 11 can rotate with the rotor or remain stationary to the rotor. As illustrated, the housing rotates with the rotor. At least one blade iron 14 is mounted to the motor 12. A blade holding attachment 16 can be mounted to the at least one blade iron 14. It is further contemplated that the at least one blade iron 14 and the blade holding attachment 16 are one piece. At least one blade 18 is attached to the at least one blade iron 14 with the blade holding attachment 16. Each blade 18 extends from a root 20 received by the blade holding attachment 16 to a tip 22. The housing 11 can include at least one slot 21 for through which the blade 18 extends from the motor 12 through the motor housing 11. In one aspect, each blade 18 is reversible, where the blade has first and second opposing surfaces 23*a*, 23*b* and can be secured to the blade holding attachment 16 with either surface facing up or down.

Figure 2:
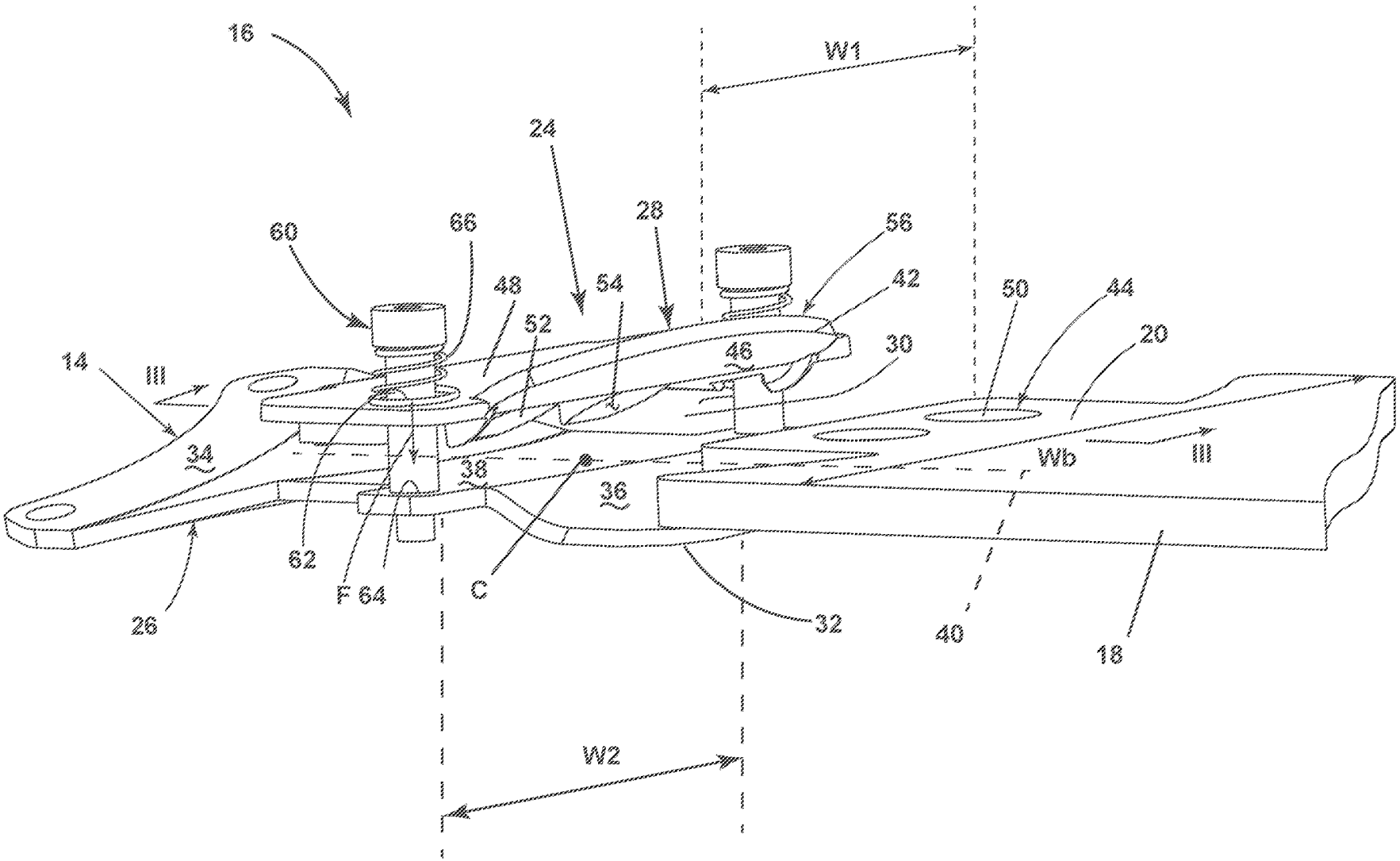
FIG. 2 is a perspective view of a variation of the snap-fit blade holding attachment from FIG. 1 according to an aspect of the disclosure herein.

Turning to FIG. 2, the blade holding attachment 16 according to an aspect of the disclosure herein is illustrated. The blade holding attachment 16 includes a snap-fit connector 24. The snap-fit connector 24 includes a first element 26 and a second element 28 spaced from the first element 26 to define a root gap 30. The root 20 of the blade can be a key with the root gap 30 defining a keyway. In other words, the root 20 functions as a key that is received in the root gap 30. The blade 18 can be sized a key width (denoted "W1") less than a blade width (denoted "Wb") at the root 20. The key width W1 corresponds with a keyway width (denoted "W2") defined by the root gap 30. The root 20 of the blade 18 includes a set of root openings 44, illustrated as two thru holes 50.

The first element 26 can be a bottom plate 32 integrally formed with and defining the blade iron 14. The bottom plate 32 can extend between a mounting end 34 and a bottom lip 36 and include a bottom horizontal section 38 therebetween. The bottom horizontal section 38 defines at least a portion of an insertion path 40 for the root 20 of the blade 18. The bottom lip 36 bends down away from the bottom horizontal section 38 for guiding the root 20 along the insertion path 40.

The second element 28 can be a top plate 42 including a top horizontal section 48 and a top lip 46. The second element 28 is movably mounted to the first element 26 between a first position 56 and a second position 58 (FIG. 3) to provide for the movement of the biased snap-fit connector 24. The second element 28 is further from the first element 26 in the first position 56. The top horizontal section 48 defines another portion of the insertion path 40. The top lip 46 bends up away from the top horizontal section 48 for guiding the root 20 along the insertion path 40. A set of biased snap pins 52 extend from the top horizontal section 48 of the second element 28 into the root gap 30 and move with the second element 28. Each snap pin of the set of biased snap pins 52 includes a ramped surface 54. The set of biased snap pins 52 correspond to the set of root openings 44 to define complementary pairs of snap pins 52 and thru holes 50.

A pair of posts 60 spaced from each other a distance equal to or greater than the keyway width W2 extend through the second element 28 and into the first element 26 each equidistant from a center (denoted "C") of the insertion path 40. The top horizontal section 48 can include post holes 62. The bottom horizontal section 38 can include a pair of post openings 64. The pair of posts 60 can be anchored in the post openings 64 and can be slideably received in the post holes 62. The second element 28 can slide along the pair of posts 60 between the first position 56 and the second position 58. A spring 66, illustrated as a coil spring 68 can be encircle each post in the pair of posts 60. The spring 66 is positioned to provide a biasing force (denoted "F") on the second element 28 from the first position 56 toward the second position 58.

When the blade root 20 is moved along the insertion path 40 into the root gap 30, engagement with the ramped surfaces 54 cause the second element 28 to move into the first position 56 where the set of biased snap pins 52 moves out of the insertion path 40 until the thru holes 50 align with corresponding snap pins of the set of biased snap pins 52.

Figure 3:
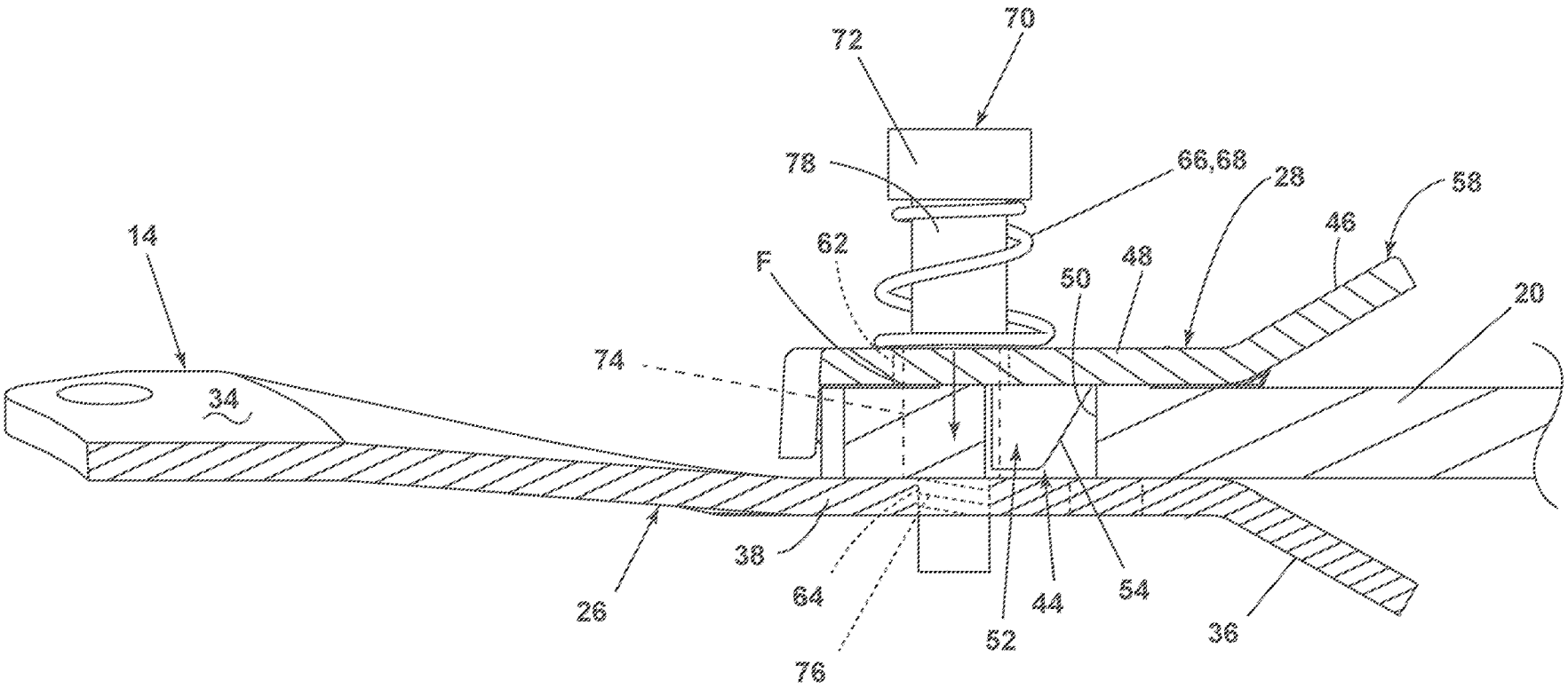
FIG. 3 is a cross-sectional view of the snap-fit blade holding attachment from FIG. 2.

Turning to FIG. 3, a cross-section taken along line III-III of FIG. 2 with the second element 28 in the second position 58 is illustrated. The biasing force F causes the set of biased snap pins 52 to be received in the set of root openings 44 as the second element 28 is forced into the second position 58 where the second element 28 is closer to the first element 26 than when in the first position 56 (FIG. 2). The pair of posts 60 can be bolts 70 with a head 72 and a shank 74 including a threaded portion 76 and a smooth portion 78. The threaded portion 76 can be anchored in the post openings 64. The smooth portion 78 of the bolt 70 can allow for sliding of the pair of posts 60 through the post holes 62. The coil spring 68 can wrap around the smooth portion 78 and extend between the head 72 and the second element 28.

Figure 4:
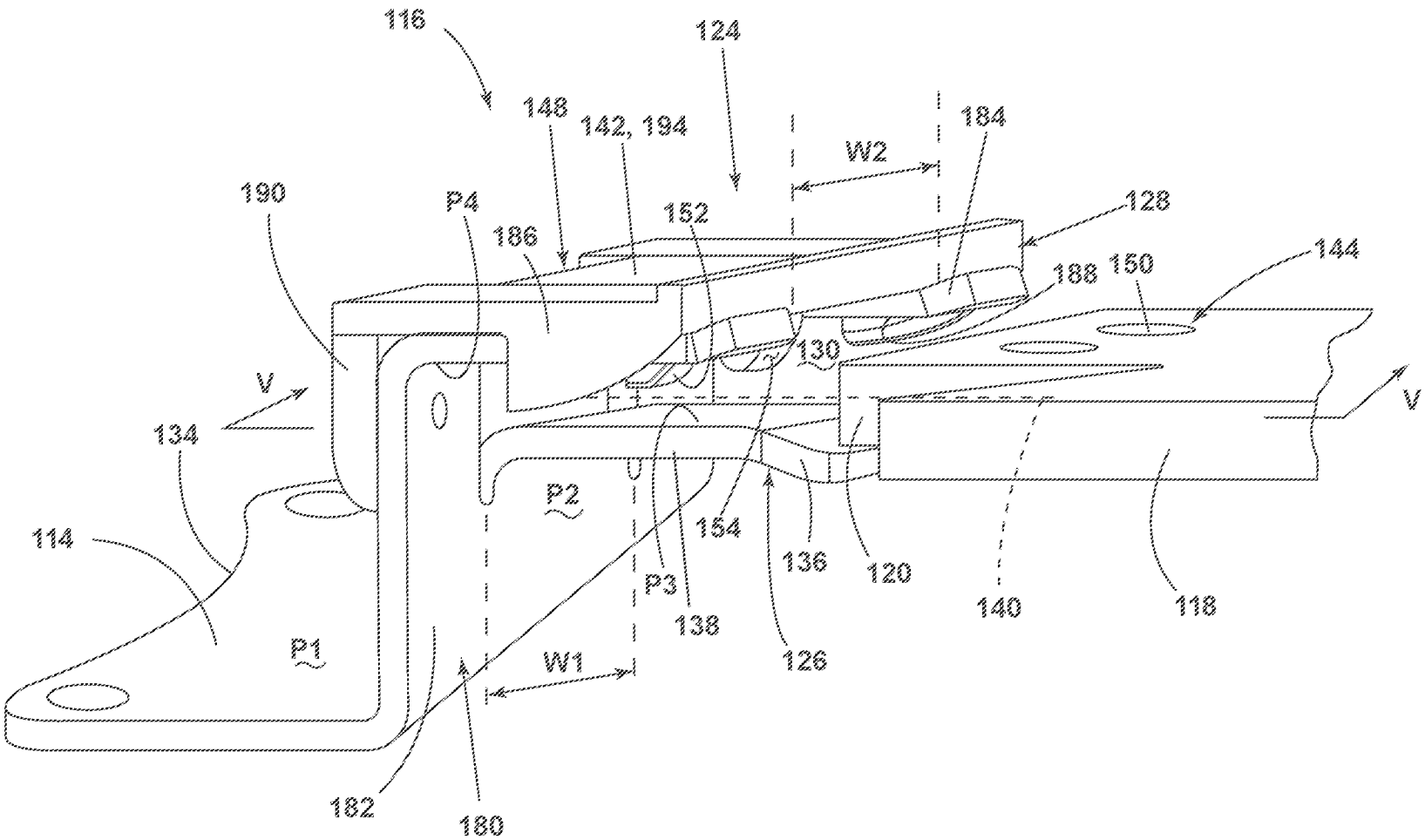
FIG. 4 is a perspective view of a variation of the snap-fit blade holding attachment from FIG. 1 according to another aspect of the disclosure herein.

FIG. 4 is a perspective view of a blade holding attachment 116 according to another aspect of the disclosure herein is illustrated. The blade holding attachment 116 is similar to the blade holding attachment 16; therefore, like parts of the blade holding attachment 116 will be identified with like numerals increased by 100, with it being understood that the description of the like parts of the blade holding attachment 16 applies to the blade holding attachment 116, except where noted.

The blade holding attachment 116 includes a biased snap-fit connector 124. The biased snap-fit connector 124 includes a first element 126 and a second element 128 spaced from the first element 126 to define a root gap 130. A blade 118 includes a set of root openings 144, illustrated as two thru holes 150, located at a root 120 of the blade 118.

The first element 126 can be integrally formed with and define a blade iron 114. The first element 126 can be a modified Z-bracket 180, where the blade iron 114 can define a first plane P1 and extend between a mounting end 134 and a connecting portion 182. The connecting portion 182 can define a second plane P2 substantially perpendicular to the first plane P1. The first element 126 can further include a bottom horizontal section 138 extending from the connecting portion 182 to define a third plane P3 substantially perpendicular to the second plane P2. The third plane P3 is pitched at an angle with respect to first plane P1 defining a desired blade pitch. A bottom lip 136 can protrude from the bottom horizontal section 138 bending downward, away from the third plane P3.

The modified Z-bracket 180 can include a fourth plane P4 spaced from, on top of, and parallel to the third plane P3. Both the third plane P3 and the fourth plane P4 extending substantially perpendicular from the second plane P2. The bottom lip 136 can be bent away from the connecting portion 182 and have a first width (denoted "W1") extending within the third plane. A set of resilient fingers 184 can extend from the connecting portion 182 within the fourth plane P4. The set of resilient fingers 184 can be spaced from and above the bottom horizontal section 138 to define an insertion path 140 between the set of resilient fingers 184 and the bottom horizontal section 138 for the root 120 of the blade 118. The set of resilient fingers 184 can be spaced from each other a second width (denoted "W2") greater than or equal to the first width W1. A set of top lips 146 can protrude from corresponding fingers of the set of resilient fingers 184 bending upward, away from the fourth plane P4.

The second element 128 can include a top plate 142 defining a living hinge 194 in a top horizontal section 148. The top plate 142 extending parallel to the fourth plane P4 on top of the set of resilient fingers 184 to define another portion of the insertion path 140 when in the top horizontal section 148. A set of biased snap pins 152 extend from the top horizontal section 148 of the second element 128 into the root gap 130. The set of biased snap pins 152 correspond to the set of root openings 144 to define complementary pairs of snap pins 152 and thru holes 150. The set of biased snap pins 152 extend toward the bottom horizontal section 138 between the set of resilient fingers 184. Each snap pin of the set of biased snap pins 152 includes a ramped surface 154.

Further, a pair of sidewalls 186 extend from the top horizontal section 148 parallel to and spaced from corresponding snap pins in the set of biased snap pins 152 to form finger slots 188. When the top plate 142 mounted to the modified Z-bracket 180, the set of resilient fingers 184 are received in corresponding finger slots 188. The second element 128 can further include a back plate 190 extending parallel to the second plane P2 and abutting the connecting portion 182.

Figure 5:
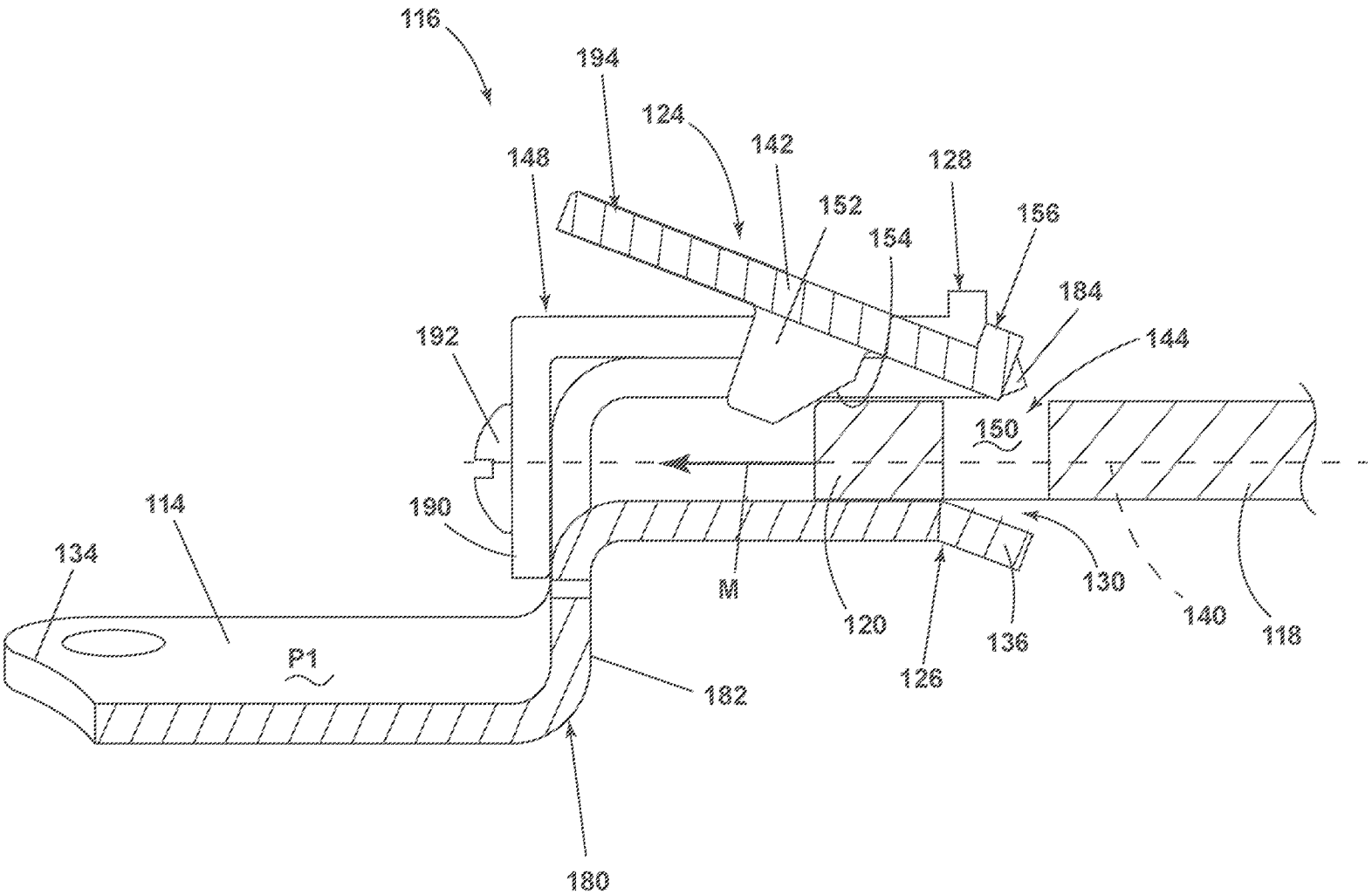
FIG. 5 is a cross-sectional view of the snap-fit blade holding attachment from FIG. 4 illustrating the insertion of the blade.

FIG. 5 is a cross-section taken along line V-V of FIG. 4 when the biased snap-fit connector 124 is in a receiving position 156 angled with respect to the horizontal position 148. The back plate 190 can be mounted, and or otherwise secured, to the connecting portion 182 by a fastener, by way of non-limiting example a bolt 192. The top plate 142 defining the living hinge 194 is moveable. When the root 120 of the blade 118 is moved into the insertion path 140, the root 120 comes in contact with the ramped surface 154 of the set of biased snap pins 152. The ramped surface 154 is angled to face the blade 118. The ramped surface 154 along with the living hinge 194 enables the top plate 142 to pivot upward when the root 120 is in contact with the ramped surface 154 to define the receiving position 156. The top plate 142 pivots along the living hinge 194 toward the bottom lip 136 of the first element 126 by a movement (denoted "M") of the root 120 into the insertion path 140.

Figure 6:
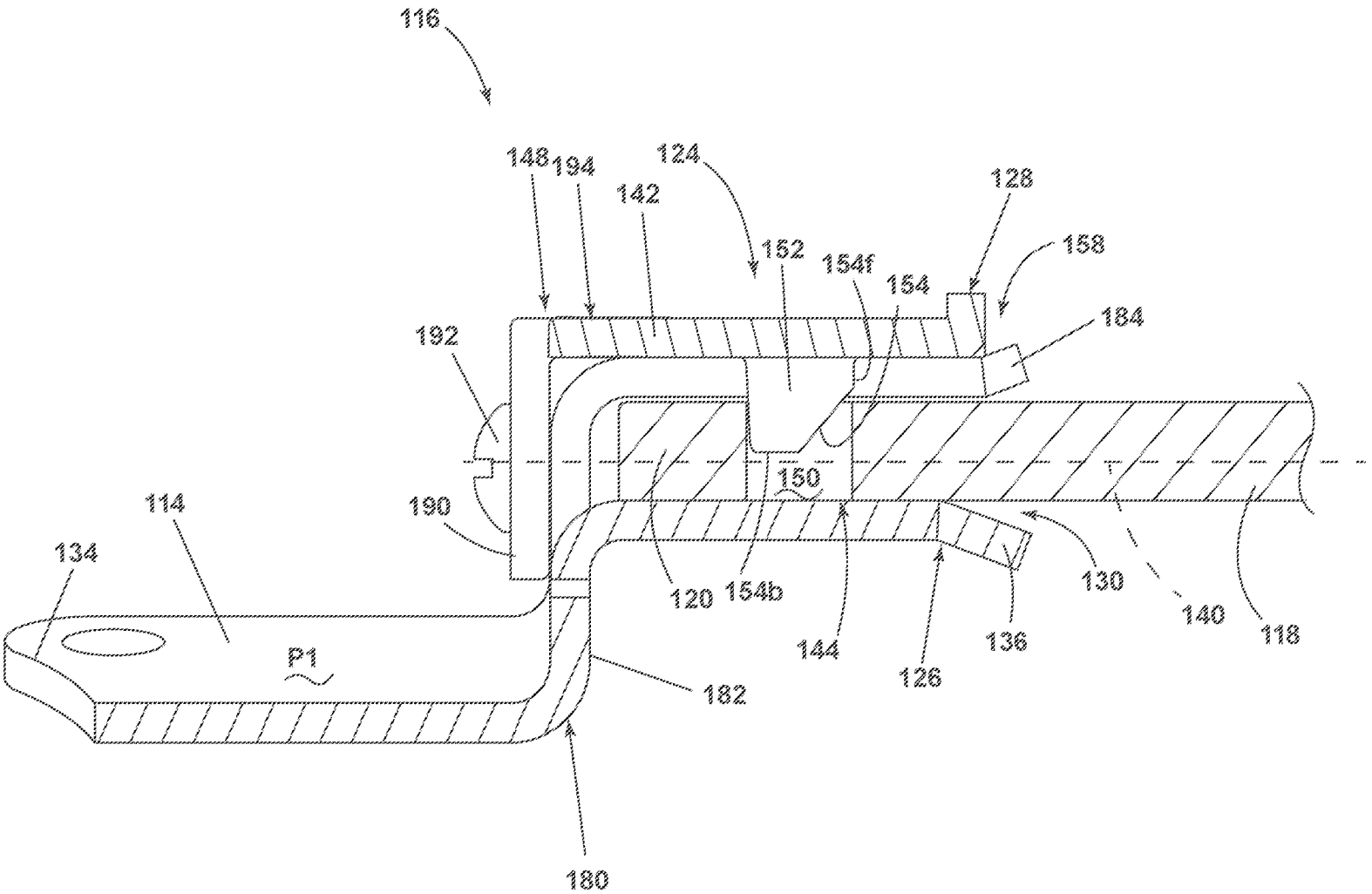
FIG. 6 is a cross-sectional view of the snap-fit blade holding attachment from FIG. 4 illustrating the blade fully installed.

FIG. 6 is a cross-section taken along line V-V of FIG. 4 when the biased snap-fit connector 124 is in a closed position 158. It can more clearly be seen that the set of biased snap pins 152 can further include a front surface 154*f* and a bottom surface 154*b*, with the ramped surface 154 extending between the front surface 154*f* and the bottom surface 154*b*. The front surface 154*f* is perpendicular to the insertion path 140 and the bottom surface 154*b* is parallel to the insertion path 140 when the set of biased snap pins 152 are fully received in the set of root openings 144. Further, as shown, when in the closed position 158 the bottom surface 154*b* can be spaced from the bottom lip 136 of the first element 126.

Figure 7:
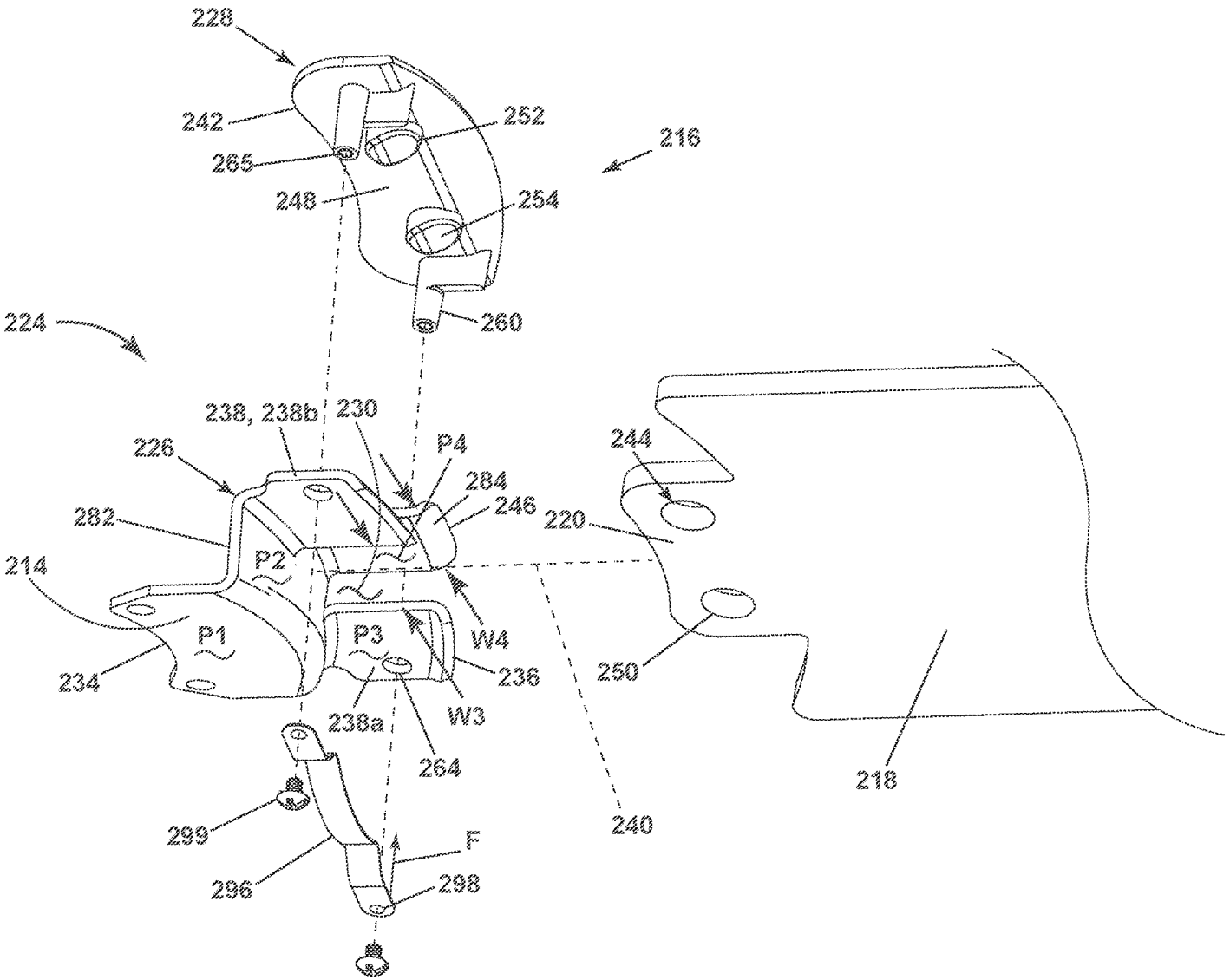
FIG. 7 is an exploded perspective view of another variation of the snap-fit blade holding attachment from FIG. 1 according to yet another aspect of the disclosure herein.

FIG. 7 is a perspective exploded view of a blade holding attachment 216 according to another aspect of the disclosure herein is illustrated. The blade holding attachment 216 is similar to the blade holding attachment 116; therefore, like parts of the blade holding attachment 216 will be identified with like numerals increased by 100, with it being understood that the description of the like parts of the blade holding attachment 116 applies to the blade holding attachment 216, except where noted.

The blade holding attachment 216 includes a biased snap-fit connector 224. The biased snap-fit connector 224 includes a first element 226 and a second element 228. The first element 226 includes a resilient finger 284 spaced from a bottom horizontal section 238 to define a root gap 230. A blade 218 includes a set of root openings 244, illustrated as two thru holes 250, located at a root 220 of the blade 218.

The first element 226 can be integrally formed with and define a blade iron 214. The first element 226 can be a modified Z-bracket 280, where the blade iron 214 can define a first plane P1 and extend between a mounting end 234 and a connecting portion 282. The connecting portion 282 can define a second plane P2 substantially perpendicular to the first plane P1. The bottom horizontal section 238 can extend from the connecting portion 282 to define a third plane P3 substantially perpendicular to the second plane P2. The third plane P3 is pitched at an angle with respect to first plane P1 defining a desired blade pitch. A bottom lip 236 can protrude from the bottom horizontal section 238 bending downward, away from the third plane P3. The bottom horizontal section 238 can be split into a first section 238*a* and a second section 238*b* spaced from the first section 238*a* a third width (denoted "W3").

The modified Z-bracket 280 can include a fourth plane P4 spaced from, on top of, and parallel to the third plane P3. A resilient finger 284 can extend from the connecting portion 282 within the fourth plane P4. The resilient finger 284 can be spaced from and above the bottom horizontal section 238 to define an insertion path 240 between the resilient finger 284 and the bottom horizontal section 238 for the root 220 of the blade 218. The resilient finger 284 has a fourth width (denoted "W4") equal to or greater than the third width W3. A top lip 246 can protrude from the resilient finger 284 bending upward, away from the fourth plane P4.

The second element 228 can include a top plate 242 defining a top horizontal section 248 extending parallel to the fourth plane P4 on top of the resilient finger 284. A set of biased snap pins 252 extend from the top horizontal section 248 of the second element 228.

A pair of posts 260 spaced from each other a distance greater than the third width W3 extend from the second element 228 each equidistant from a center (denoted "C") of the insertion path 240. The bottom horizontal section 238 can include a pair of post openings 264. The pair of posts 260 can extend through the pair of post openings 264. Each of the pair of posts 260 can include a threaded insertion hole 265.

A flat spring 296 can be positioned to provide a biasing force (denoted "F") on the bottom horizontal section 238 and in turn the second element 228 in reaction to a force exerted on a ramped surface 254 of the set of biased snap pins 252 from the root 220 of the blade 218 when inserted along the insertion path 240. The flat spring 296 can include a pair of spring openings 298 that when assembled align with the pair of post openings 264. The pair of posts 260 can be anchored in the pair of spring openings 298 via, by way of non-limiting example a bolt 299 received within the threaded insertion hole 265.

In addition to the concepts covered by the claims, the following clauses can also provide for the basis for claims in any possible combination:

A ceiling fan comprising a motor housing having at least one blade iron; at least one blade extending from a root to a tip, and having a set of multiple, spaced, through openings at the root; and a snap-fit connector securing the at least one blade to the blade iron and comprising a first element and a second element, which is spaced from the first element to define a root gap defining an insertion path for the root of the blade, a set of biased snap pins corresponding to the set of through openings to define complementary pairs of snap pins and through openings, wherein at least one of the first and second elements is integrally formed as part of the blade iron, and when the blade root is moved along the insertion path, the set of biased snap pins moves out of the insertion path until the through openings align with the set of biased snap pins, which are then biased into the through openings.

The ceiling fan of any preceding clause wherein the first element is integrally formed with the blade iron.

The ceiling fan of any preceding clause wherein the biased snap pins are coupled second element, which is movably mounted to the first element to provide for the movement of the biased snap pins.

The ceiling fan of any preceding clause wherein the second element is moveable between first and second positions, with the first position closer to the first element than the second position.

The ceiling fan of any preceding clause wherein the second element is biased from the second position toward the first position.

The ceiling fan of any preceding clause wherein the second element slides along a pair of posts extending from the first element, with a spring provided on each of the posts in the pair of posts to bias the second element from the second position toward the first position.

The ceiling fan of any preceding clause wherein the pair of posts comprise bolts, having a head and threaded shank, threaded into the first element.

The ceiling fan of any preceding clause wherein each spring is a coil spring encircling the threaded shank and extending between the head and the second element.

The ceiling fan of any preceding clause wherein the second element comprises a pair of posts slidably received within corresponding post openings in the first element.

The ceiling fan of any preceding clause further comprising a spring carried by the first element and coupled to the pair of posts to bias the second element from the second position to the first position.

The ceiling fan of any preceding clause wherein the spring comprises a flat spring.

The ceiling fan of any preceding clause wherein the flat spring is located on an opposite side of the first element as the second element.

The ceiling fan of any preceding clause wherein the second element comprises a set of root openings, which are paired with the set of biased snap pins to form corresponding complementary pairs of snap pins and thru holes.

The ceiling fan of any preceding clause wherein the fingers comprise a living hinge, which the fingers pivot about when the biased snap pins move.

The ceiling fan of any preceding clause wherein the fingers are secured to the blade iron.

The ceiling fan of any preceding clause wherein the biased snap pins comprise a ramped surface facing the blade root as the blade is moved along the insertion path.

The ceiling fan of any preceding clause wherein the biased snap pins further comprising a front surface and a bottom surface, with the ramped surface extending between the front surface and the bottom surface.

The ceiling fan of any preceding clause wherein the front surface is perpendicular to the insertion path and the bottom surface is parallel to the insertion path.

The ceiling fan of any preceding clause wherein the biased snap pins extend only partially into the through openings.

The ceiling fan of any preceding clause wherein the blade is reversible, wherein the blade has first and second opposing surfaces and can be secured to the biased snap-fit connection with the first surface either facing up or down.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan comprising:

a motor housing having at least one blade iron;

at least one blade extending from a root to a tip, and having a set of multiple, spaced, through openings at the root; and a snap-fit connector securing the at least one blade to the blade iron and comprising:

a first element and a second element, which is spaced from the first element to define a root gap defining an insertion path for the root of the blade, a set of biased snap pins corresponding to the set of through openings to define complementary pairs of snap pins and through openings, wherein at least one of the first and second elements is integrally formed as part of the blade iron, and when the blade root is moved along the insertion path, the set of biased snap pins moves out of the insertion path until the through openings align with the set of biased snap pins, which are then biased into the through openings;

wherein the second element slides along a pair of posts extending from the first element, with a spring provided on each of the posts in the pair of posts to bias the second element along the pair of posts; and wherein the pair of posts comprise bolts, having a head and threaded shank, threaded into the first element.

2. The ceiling fan of claim 1 wherein the first element is integrally formed with the blade iron.

3. The ceiling fan of claim 2 wherein the biased snap pins are coupled to the second element, which is movably mounted to the first element to provide for the movement of the biased snap pins.

4. The ceiling fan of claim 3 wherein the second element is moveable between first and second positions, with the first position closer to the first element than the second position.

5. The ceiling fan of claim 4 wherein the second element is biased from the second position toward the first position.

6. The ceiling fan of claim 1 wherein each spring is a coil spring encircling the threaded shank and extending between the head and the second element.

7. The ceiling fan of claim 5 wherein the second element comprises a pair of posts slidably received within corresponding post openings in the first element.

8. The ceiling fan of claim 7 further comprising a spring carried by the first element and coupled to the pair of posts to bias the second element from the second position to the first position.

9. The ceiling fan of claim 8 wherein the spring comprises a flat spring.

10. The ceiling fan of claim 9 wherein the flat spring is located on an opposite side of the first element as the second element.

11. The ceiling fan of claim 5 wherein the second element comprises at least one resilient finger carrying the snap pins.

12. The ceiling fan of claim 11 wherein the at least one resilient finger comprises a living hinge, which the at least one resilient finger pivots about when the biased snap pins move.

13. The ceiling fan of claim 12 wherein the at least one resilient fingers is secured to the blade iron.

14. The ceiling fan of claim 1 wherein the biased snap pins comprise a ramped surface facing the blade root as the blade is moved along the insertion path.

15. The ceiling fan of claim 14 wherein the biased snap pins further comprising a front surface and a bottom surface, with the ramped surface extending between the front surface and the bottom surface.

16. The ceiling fan of claim 15 wherein the front surface is perpendicular to the insertion path and the bottom surface is parallel to the insertion path.

17. The ceiling fan of claim 1 wherein the biased snap pins extend only partially into the through openings.

18. The ceiling fan of claim 1 wherein the blade is reversible, wherein the blade has first and second opposing surfaces and can be secured to the biased snap-fit connection with the first surface either facing up or down.

* * * * *